US011746518B2

(12) United States Patent
Rajewski

(10) Patent No.: US 11,746,518 B2
(45) Date of Patent: Sep. 5, 2023

(54) BALANCED HYDROVAC

(71) Applicant: Robert Carl Rajewski, Stettler (CA)

(72) Inventor: Robert Carl Rajewski, Stettler (CA)

( * ) Notice: Subject to any disclaimer, the term of this patent is extended or adjusted under 35 U.S.C. 154(b) by 381 days.

(21) Appl. No.: 16/937,540

(22) Filed: Jul. 23, 2020

(65) Prior Publication Data

US 2021/0025155 A1 Jan. 28, 2021

Related U.S. Application Data

(60) Provisional application No. 62/877,641, filed on Jul. 23, 2019.

(51) Int. Cl.
*E03F 7/10* (2006.01)
*E02F 3/88* (2006.01)

(52) U.S. Cl.
CPC ..... *E03F 7/103* (2013.01); *E02F 3/8816* (2013.01)

(58) Field of Classification Search
CPC ..... E03F 7/103; E02F 3/8816
See application file for complete search history.

(56) References Cited

U.S. PATENT DOCUMENTS 6,547,964 B1 * 4/2003 Rajewski ..... B01D 21/02 210/241
2018/0087237 A1 3/2018 Rajewski

FOREIGN PATENT DOCUMENTS

CA 2778670 A1 * 11/2013 ..... E02F 3/8816
WO WO-2014203471 A1 * 12/2014 ..... B63B 25/16

* cited by examiner

*Primary Examiner* — Tara Mayo
(74) *Attorney, Agent, or Firm* — Lambert Intellectual Property Law

(57) ABSTRACT

A hydrovac unit with a mud tank and water tank arranged symmetrically, so that the center of gravity does not substantially shift forwards or backwards during operation. The mud tank may be located inside the water tank. The mud tank may be supported and reinforced by external ribs, which may be fixed to the mud tank. The water tank may be formed by a rear face attached to the mud tank and a cylinder portion, the mud tank and rear face sliding into the cylinder portion for assembly and secured in place. The contents of the hydrovac unit may be dumped by tilting using a hoist. The tank assembly may be heated and insulated.

20 Claims, 4 Drawing Sheets

BALANCED HYDROVAC

TECHNICAL FIELD

Hydrovacs.

BACKGROUND

Regulations limit the weight on the wheels in hydrovacs. Distribution of weight within the hydrovac during and outside of operation is a continuing issue.

US patent publication number 2018-0087237 includes details of a hydrovac unit.

SUMMARY

A tank configuration for a hydrovac can include a water tank and a mud tank, the water tank surrounding the mud tank at least partly on lateral sides of the mud tank. In various embodiments, there may be included any one or more of the following features: The lateral sides of the mud tank may connect to form a bottom of the mud tank. The tank configuration may have a cross section in which the water tank surrounds the mud tank. The water tank may entirely surround the mud tank except for one end of the mud tank including an exit or unloading door. The mud tank may be substantially cylindrical. The mud tank may be arranged slidably within the water tank except for an attachment at one end of the tank configuration. The mud tank may be supported by ribs within the water tank. The ribs may define holes for allowing water flow through the ribs. The ribs may be fixed to the mud tank and slidably positioned within the water tank.

A tank configuration for a hydrovac, the tank configuration including a water tank and a mud tank, the tanks being shaped to define a level orientation such that, when fluid is within each of the water tank and mud tank up to respective horizontal planes in the water tank and the mud tank, the fluid within each of the water tank and mud tank defines respective centers of volume, the centers of volume having respective positions in a forward-backward dimension that substantially coincide and are substantially independent of respective heights of the respective horizontal planes.

The respective centers of volume may also have respective positions in a lateral dimension that substantially coincide and are substantially independent of respective heights of the respective horizontal planes.

A hydrovac unit may include any of the tank configurations described above.

In various embodiments, there may be included any one or more of the following features: there may be at least one front axle and one or more rear axles, in which the water tank and mud tank are centered substantially above or in front of the one or more rear axles. The water tank and mud tank may be centered substantially above the one or more rear axles. The water tank and mud tank may be centered in front of the one or more rear axles. There may be a heater for heating water in the water tank. The heater may be located inside the water tank. There may be insulation about the water tank. The tank configuration is mounted on a hoist for dumping from at least the mud tank.

BRIEF DESCRIPTION OF THE FIGURES

Embodiments will now be described with reference to the figures, in which like reference characters denote like elements, by way of example, and in which.

DETAILED DESCRIPTION

Immaterial modifications may be made to the embodiments described here without departing from what is covered by the claims.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

A "hydrovac unit" as used herein comprises the necessary conventional components, some of which are for example described herein, to make a hydrovac unit work. When the word "mounted" is used, the item may be mounted directly or indirectly on the object referred to.

Figure 1:
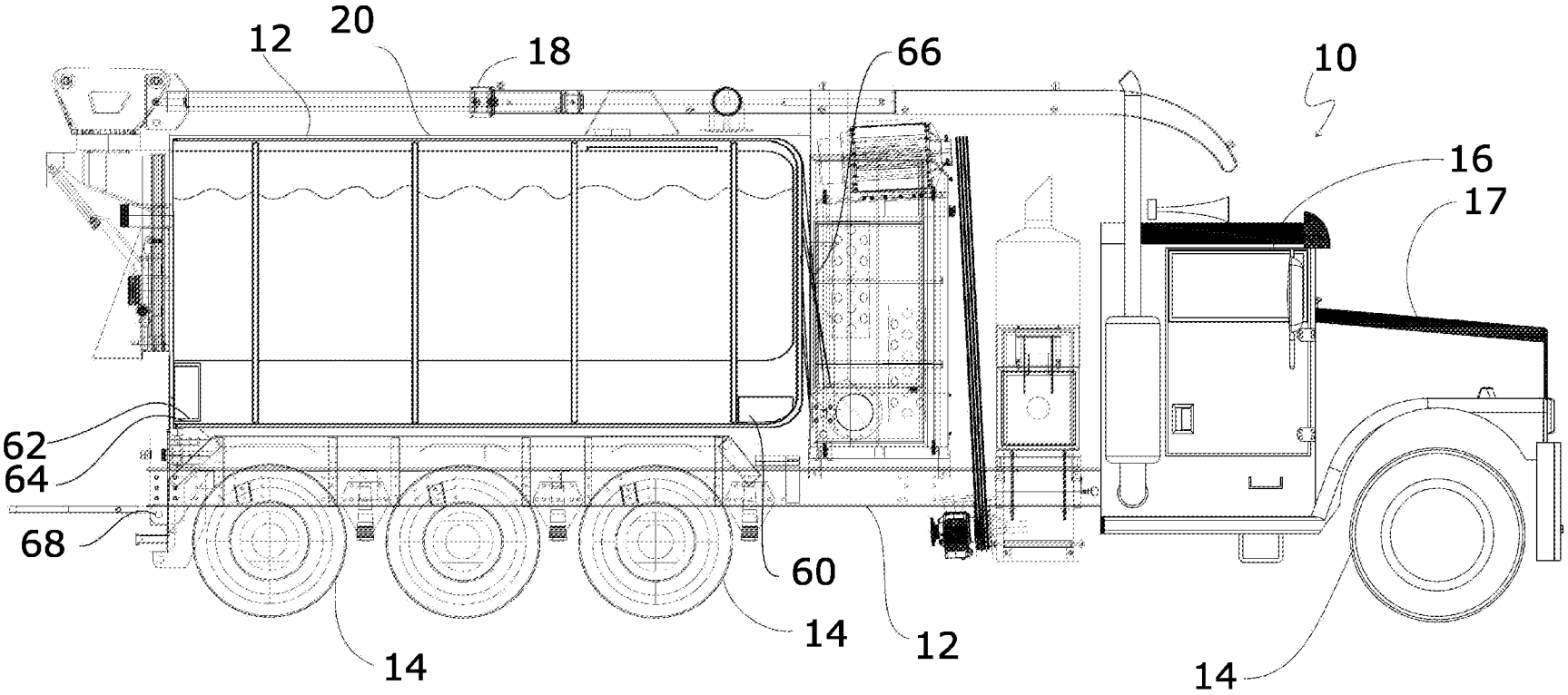
FIG. 1 is a partial cross-sectional view taken along the length of an embodiment of a hydrovac unit.

Referring to FIG. 1, there is shown a hydrovac unit 10. A hydrovac unit 10 has a chassis 12 mounted on wheels 14. Each wheel shown corresponds to an axle. Instead of separate wheels, tracks (not shown) could also be used. At the front of chassis 12 there may be a cab 16 and an engine 17. The cab 16 defines the front of the hydrovac 10. For clarity, various conventional components of the hydrovac are not illustrated, e.g. a suspension. A boom 18 is mounted on the rear of chassis 12. The boom 18 carries a hose (not shown) that is used to dig holes for example for placing utility equipment such as utility poles. A blower (not shown) may maintain vacuum to suck air through the hose. Controls (not shown) for a mud and water tank assembly 20, hose, and boom 18 may be mounted on a panel at the rear of the chassis 12. A wand (not shown) may extend from the rear of the chassis and the boom controls may be located on the wand. The tanks assembly may be, in an example, 14 to 15' long, and centered over the rear axles so that the load is borne by the rear axles or just ahead of them so that the front axle shares some of the load.

Figure 2A:
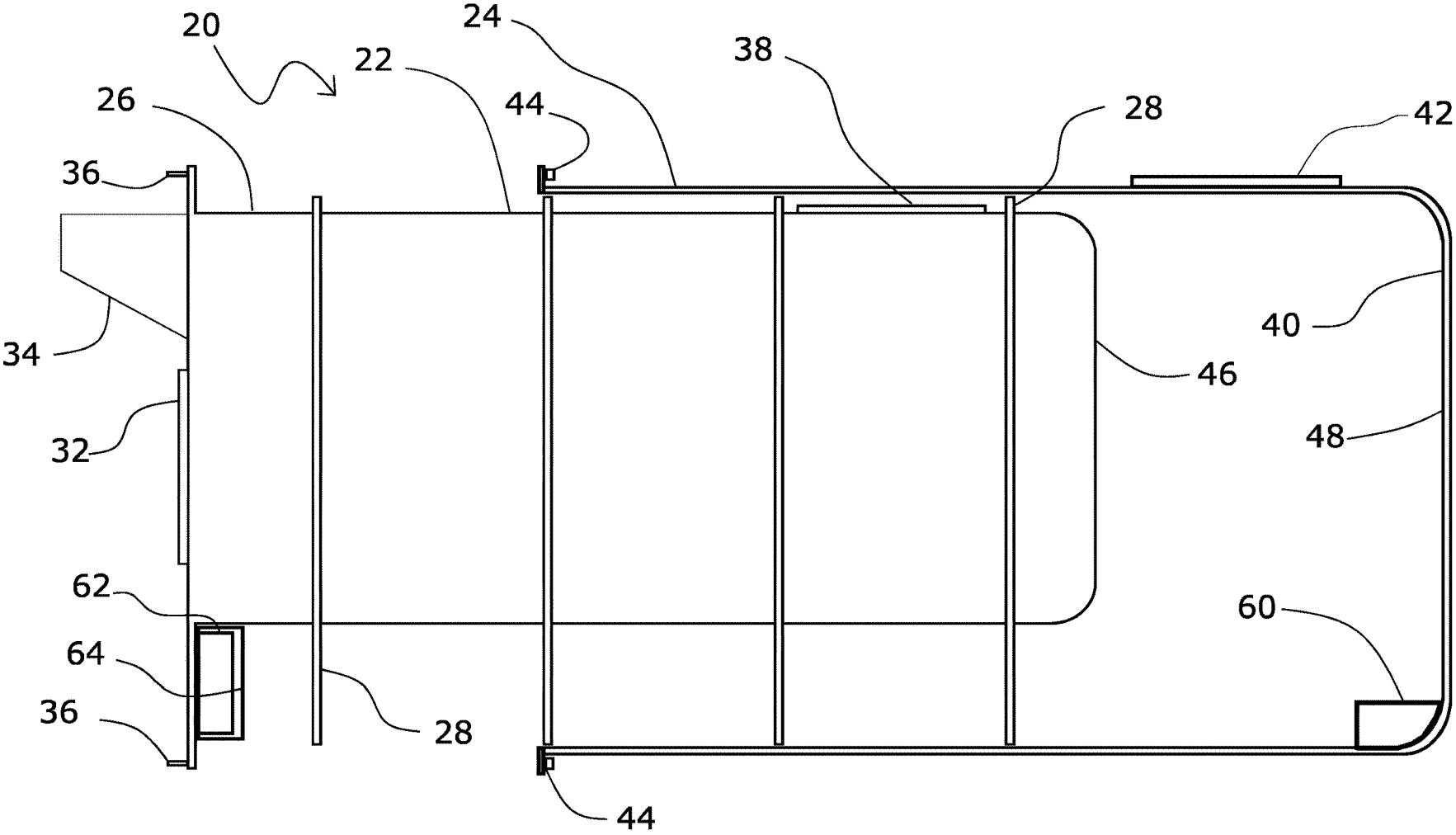
FIG. 2A is a cross-sectional view taken along the length of the rear chassis of an embodiment of a hydrovac unit, in exploded form.
Figure 2B:
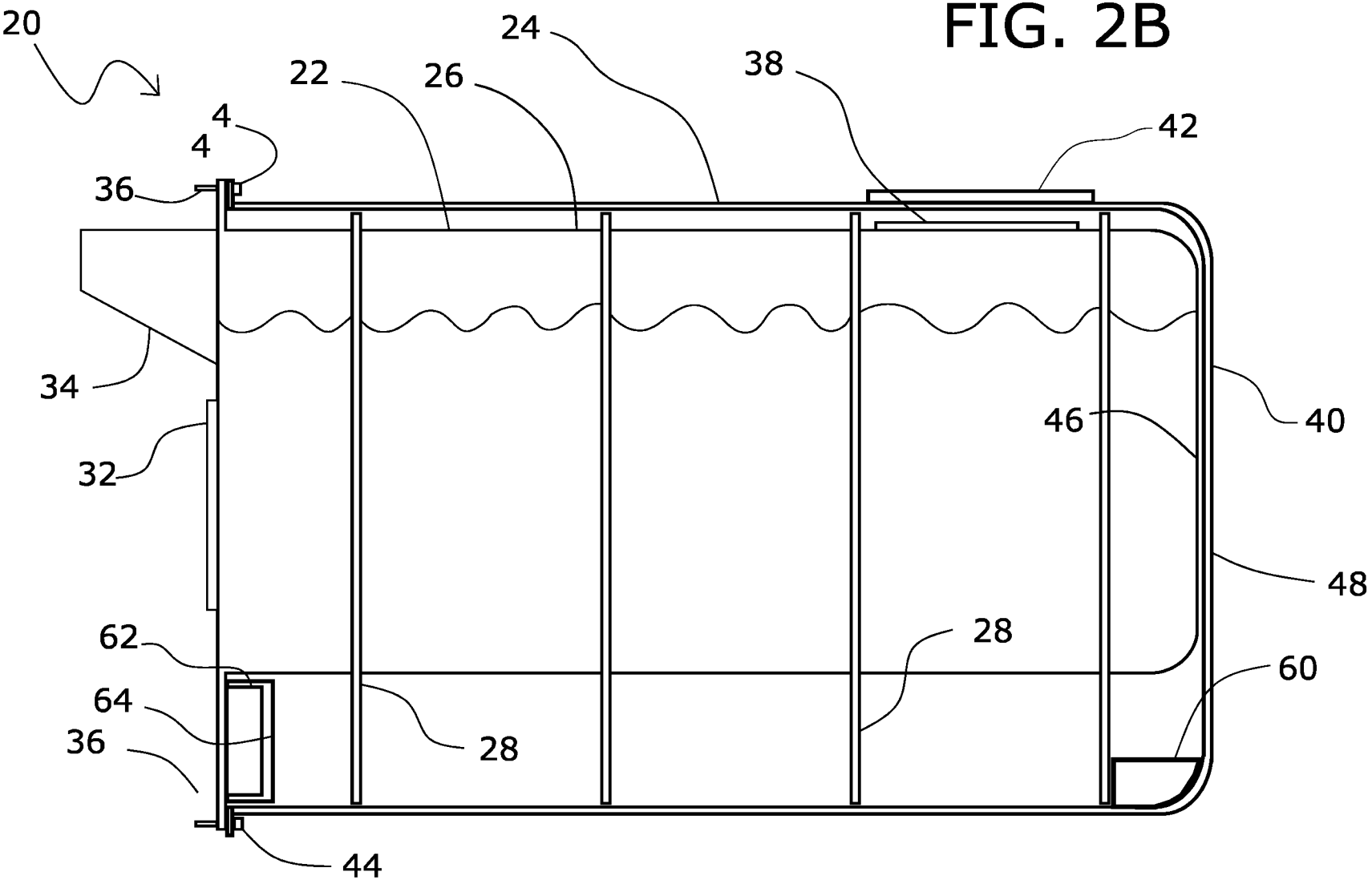
FIG. 2B is a cross-sectional view taken along the length of the rear chassis of an embodiment of a hydrovac unit.

Referring to FIG. 2, a mud and water tank assembly, generally indicated by reference numeral 20, for the hydrovac unit 10 may comprise a sliding unit 22 and a containing unit 24. Sliding unit 22 in the embodiment shown comprises a mud tank 26, ribs 28 fixed to the mud tank, e.g. by welding, and a rear face 30 of the sliding unit 22, the rear face 30 including a dump door 32, a boom turret 34, and sliding unit connectors 36 for securing the sliding unit 22 to the containing unit 24. The mud tank 26 may also include an access port 38.

The mud tank typically contains material that has been vacuumed from a dig site, which may include mud or other materials. Materials and air may be sucked through a hose into the mud tank by a vacuum (sub-atmospheric) pressure maintained within or connected to the mud tank.

The containing unit 24 may define a water tank 40 in combination with the sliding unit 22. The water tank 40 may receive water within an enclosed space defined by the containing unit 24 and the sliding unit 22 when the sliding unit 22 is secured to the containing unit 24. The containing unit 24 may include an access port 42 which may align with access port 38 in the mud tank when the sliding unit 22 is secured to the containing unit 24. Containing unit connectors 44, e.g. nuts, may cooperate with sliding unit connectors 36, e.g. bolts, to secure the sliding unit 22 to the containing unit 24.

The ribs 28 may be positioned slidably within the water tank to allow the mud tank to slide within the water tank when not secured using connectors 36 and 44. This may enable easier assembly and repair. The mud tank and water tank may alternatively be permanently fixed to each other. The mud tank may have a front end 46 and the water tank an interior front end 48. These portions may have a small clearance with respect to one another, or the front end 46 may abut the interior front end 48 in the secured position. As shown and described, the mud tank is within the water tank, but the water tank could alternatively be located within the mud tank. The mud tank being within the water tank is more convenient for dumping of the mud, in part because the higher height of the bottom of the mud tank enables dumping of mud into roll off bins on job sites more easily. This is useful to enable hydrovacs to stay working instead of driving to dump.

Figure 3:
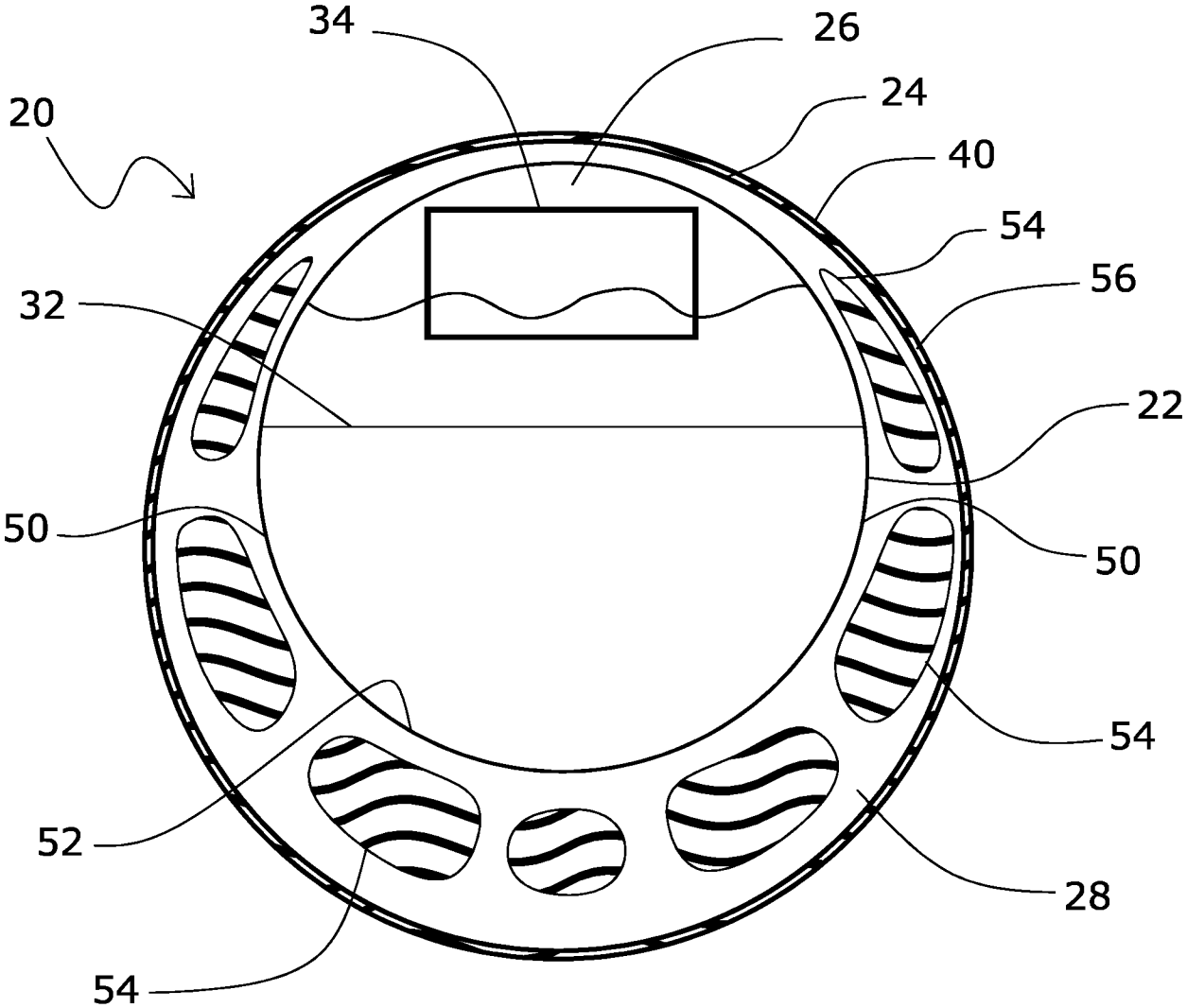
FIG. 3 is a cross-sectional view taken along a width of the rear chassis of an embodiment of a hydrovac unit.

Referring to FIG. 3, a longitudinally-facing cross section of a tank configuration shows ribs 28 supporting the mud tank 26 within the water tank 40. The water tank 40 surrounds the mud tank 26, including at lateral sides 50. The lateral sides 50 in this embodiment connect to form a bottom 52 of the mud tank, so that the water tank also extends under the bottom 52 of the mud tank. In the cross section shown, the ribs 28 define holes 54 for allowing water flow through the ribs. This enables the water tank to act as a single tank. The holes as shown are an example only and may for example be smaller than shown. The ribs 28 may provide a well baffled water tank. The ribs 28 extend in the embodiment shown all the way around the mud tank 26. Mud tank 26 and water tank 40 are in the embodiment shown both substantially cylindrical. In the embodiment shown, in the cross section shown in FIG. 3, the water tank 40 entirely surrounds the mud tank 26.

In the example cross section shown in FIG. 3, a gap 56 is shown between the ribs 28 and the outer tank to account for tolerances. The gap is not shown to scale. Boom turret 34 and dump door 32 can also be seen in FIG. 3.

The design shown may be constructed from, for example, ⅛" thick stainless steel. The use of stainless steel can avoid the need for internal coatings, or treatments such as sandblasting, of the tanks. In an example, the ribs 28 are positioned at intervals of 16". The ribs 28 not only support the mud tank 26 within the water tank 40, but also reinforce the mud tank 26, allowing it to withstand vacuum pressure with thinner materials than if there were no ribs. The design with one tank within the other also avoids wasted space within the hydrovac unit.

It is desired to avoid load shift when water empties from the outer tank and is added to the mud tank. To avoid this, the tanks may be designed as follows. The tanks define a level orientation such that, when fluid is within each of the water tank and mud tank up to respective horizontal planes in the water tank and the mud tank, the fluid within each of the water tank and mud tank defines respective centers of volume, the centers of volume having respective positions in a forward-backward dimension that substantially coincide and are substantially independent of respective heights of the respective horizontal planes. In the example embodiment shown where the tanks are cylinders, an orientation where the axes of the cylinders are horizontal is such an orientation. When the tanks are in the level orientation, the coinciding and non-moving centers of volume prevent the center of mass of the contents of the tanks (where these contents in respect of each tank are of substantially uniform density) from shifting forward or back as fluid is added or removed. Likewise, in the embodiment shown the respective centers of volume also have respective positions in a lateral dimension that substantially coincide and are substantially independent of respective heights of the respective horizontal planes. This prevents a lateral shift. Any tank arrangement in which each tank is substantially symmetric in a horizontal dimension, will have a position of the center of volume in that horizontal dimension that is substantially independent of the height of the horizontal plane up to which fluid is present. The centers of volume can be made to coincide in the horizontal dimensions by positioning of the tanks, for example one within another or one above another.

The prevention of load shifting enables the positioning of the tanks and the corresponding loads from the contained material, to be selected for benefits that will be maintained as fluid leaves one tank and enters another. In an example, the hydrovac may include at least one front axle. In the embodiment shown there is a single front axle, but additional axles could be placed near the single axle shown. The hydrovac may also include one or more rear axles, for example three rear axles placed near each other as shown. The tanks may be centered substantially above or in front of the one or more rear axles. With the water tank and mud tank centered substantially above the rear axles, the additional weight added as the tanks are filled is borne by the rear axles. With water tank and mud tank centered in front of the one or more rear axles, some of the additional weight is borne by the at least one front axle. The positioning may be selected to improve the maximum weight carried without exceeding per-axle load limits. Non-shifting of the weight enables the weight to be distributed between the axles in a desired fashion both when the water tank is loaded and the mud tank empty and when the mud tank is loaded.

As shown in FIG. 1 the hydrovac may include heater 60 for heating water in the water tank. In the example shown, the heater is located inside the water tank. The heater may be a boiler. The water tank can be heated by circulating water through the boiler to heat the water to elevated temperatures. The heated water can thaw material that has been sucked into the mud tank, like ice, frozen chunks, snow, etc. This is made more effective by the positioning of the mud tank within the water tank. This thawing also avoids the material freezing in the mud tank and requiring people to come to wash it back out. The hot water in the water tank may also assist in the heating of door seals, e.g. of the dump door, to prevent freezing of the door seals. The hot water may also protect the heater, as positioning the heater within the water tank avoids the need for external water lines, which could if present freeze or require protection.

The water tank may have insulation such as foil wrap insulation and stainless steel cladding. The insulation around the water tank also protects the mud tank where the water tank is around the mud tank. If the water is warmed up, the material in the mud tank can be prevented from freezing overnight even in cold climates, avoiding the need to dump at the end of the job if you have to travel.

A hydrovac may include a water pump 62 to supply water, e.g. through a wand (not shown) to the dig location. The water pump 62 may be included in an internal enclosure 64, for example in the bottom rear of the water tank area. This positioning avoids the risk of freezing of external water lines.

The hydrovac may include a hoist 66 for dumping. The tank assembly may be hingedly connected to hinge 68. By tilting the tanks around hinge 68 using the hoist and opening dump door 32, material from the mud tank 26 can be dumped from the mud tank 26 through the dump door 32. This allows easy dumping of the mud tank contents regardless of composition, e.g. including rock, mud or sand. This positioning of the tanks may also be used to assist in more completely draining the water tank 40 if desired.

The embodiments of the invention in which an exclusive property or privilege is claimed are defined as follows:

1. A tank configuration for a hydrovac, the tank configuration including a water tank and a mud tank, the water tank surrounding the mud tank at least partly on lateral sides of the mud tank, the lateral sides of the mud tank connecting to form a bottom of the mud tank, the mud tank being supported by ribs within the water tank, and the ribs defining holes for allowing water flow through the ribs.

2. The tank configuration of claim 1 in which the tank configuration has a cross section in which the water tank surrounds the mud tank.

3. The tank configuration of claim 2 in which the water tank entirely surrounds the mud tank except for one end of the mud tank including an exit or unloading door.

4. The tank configuration of claim 2 in which the mud tank is arranged slidably within the water tank except for an attachment at one end of the tank configuration.

5. The tank configuration of claim 1 in which the mud tank is substantially cylindrical.

6. The tank configuration of claim 5 in which the mud tank is arranged slidably within the water tank except for an attachment at one end of the tank configuration.

7. The tank configuration of claim 1 in which the mud tank is arranged slidably within the water tank except for an attachment at one end of the tank configuration.

8. The tank configuration of claim 1 in which the ribs are fixed to the mud tank and slidably positioned within the water tank.

9. A hydrovac including the tank configuration of claim 1.

10. A hydrovac unit having a tank configuration including a water tank and a mud tank, the water tank surrounding the mud tank at least partly on lateral sides of the mud tank, the tank configuration being mounted on a hoist for dumping from at least the mud tank.

11. The hydrovac unit of claim 10 further comprising at least one front axle and one or more rear axles, in which the water tank and mud tank are centered substantially above or in front of the one or more rear axles.

12. The hydrovac unit of claim 11 in which the water tank and mud tank are centered substantially above the one or more rear axles.

13. The hydrovac unit of claim 11 in which the water tank and mud tank are centered in front of the one or more rear axles.

14. The hydrovac unit of claim 10 further comprising a heater for heating water in the water tank.

15. The hydrovac unit of claim 14 in which the heater is located inside the water tank.

16. The hydrovac unit of claim 14 further comprising insulation about the water tank.

17. A hydrovac unit having a tank configuration including a water tank and a mud tank, the tanks being shaped to define a level orientation such that, when fluid is within each of the water tank and mud tank up to respective horizontal planes in the water tank and the mud tank, the fluid within each of the water tank and mud tank defines respective centers of volume, the centers of volume having respective positions in a forward-backward dimension that substantially coincide and are substantially independent of respective heights of the respective horizontal planes, in which the tank configuration is mounted on a hoist for dumping from at least the mud tank.

18. The hydrovac unit of claim 17 in which the respective centers of volume also have respective positions in a lateral dimension that substantially coincide and are substantially independent of respective heights of the respective horizontal planes.

19. The hydrovac unit of claim 17 further comprising at least one front axle and one or more rear axles, in which the water tank and mud tank are centered substantially above or in front of the one or more rear axles.

20. The hydrovac unit of claim 17 further comprising a heater for heating water in the water tank.

* * * * *